United States Patent [19]

Graves

[11] Patent Number: 4,530,188

[45] Date of Patent: Jul. 23, 1985

[54] SHARPENING APPARATUS

[75] Inventor: Louis N. Graves, Anoka, Minn.

[73] Assignee: Louis N. Graves Company, Inc., Anoka, Minn.

[21] Appl. No.: 496,412

[22] Filed: May 19, 1983

[51] Int. Cl.[3] ..... B24D 15/08

[52] U.S. Cl. ..... 51/214; 51/205 WG; 51/181 R; 76/86

[58] Field of Search ..... 51/214, 211 R, 181 R, 51/205 R, 205 WG, 285; 76/82, 82.2, 84, 86

[56] References Cited

U.S. PATENT DOCUMENTS

| | | | |
|---|---|---|---|
| 1,016,615 | 2/1912 | Dow et al. | 76/86 |
| 1,041,631 | 10/1912 | Johnson | 51/214 |
| 1,719,345 | 7/1929 | Teitel | 76/86 |
| 1,939,482 | 12/1933 | Aurili | 51/214 |
| 2,413,169 | 12/1946 | Case | 51/214 |
| 4,272,925 | 6/1981 | Graves | 51/211 R |
| 4,428,515 | 1/1984 | Mayer | 51/214 |

FOREIGN PATENT DOCUMENTS

| | | | |
|---|---|---|---|
| 0408887 | 1/1968 | Australia | 51/214 |
| 0803593 | 10/1936 | France | 51/214 |
| 0424641 | 2/1935 | United Kingdom | 76/86 |

*Primary Examiner*—Frederick R. Schmidt
*Assistant Examiner*—Robert A. Rose
*Attorney, Agent, or Firm*—Burd, Bartz & Gutenkauf

[57] ABSTRACT

A pocket-size sharpening apparatus of the variety carrying sharpening rods disposed in crossed relationship. The sharpening apparatus has a body with a distal face carrying clips to releasably secure a pair of sharpening rods in crossed relationship. A major access opening permits access to portions of the sharpening rods from a proximal face of the body for the purpose of sharpening a blade. The major access opening has a V-shaped portion extended inward from a mouth with convergent edges disposed in parallel relationship to and exposing convergent portions of the sharpening rods from the proximal face. A minor access opening is comprised as a slot extending inward of the body toward the major opening a sufficient distance to expose opposite intersecting portions of the sharpening rods. A peripheral protective lip can line the major and minor openings on the proximal face of the body. A groove can be provided in the body wherein the sharpening rods can be seated and manually held in side-by-side, parallel relationship for the sharpening of pointed objects.

17 Claims, 7 Drawing Figures

SHARPENING APPARATUS

SUMMARY OF THE INVENTION

The invention relates to a pocket-size sharpening apparatus of the variety carrying sharpening rods disposed in crossed relationship, preferably at a relative angle of about 45 degrees. Such sharpening devices are popular because of the ease of properly aligning a knife blade at a nearly optimum angle with respect to a sharpening rod during a sharpening procedure. Such a device that is small in size is desirable for reasons of storage and portability.

The sharpening apparatus includes a flat, planar generally rectangular body. A first or distal face of the body has clip means to releasably secure a pair of sharpening rods in crossed relationship. The base has a major access opening to permit access to portions of the sharpening rods from the second or proximal face of the body for the purpose of sharpening a knife blade or the like. The major access opening has a mouth defined by parallel, spaced apart edges, and a V-shaped portion extended inward from the mouth with convergent edges disposed in parallel relationship to convergent portions of the sharpening rods. The convergent edges are positioned to expose the inner portions of the rods from the proximal face of the body to the crotch or apex formed at the intersection of the rods for access by a knife blade. A minor access opening is comprised as a slot extending inward of the body toward the major opening a sufficient distance to expose the intersecting portions of the sharpening rods opposite that exposed at the major opening. A peripheral protective lip can line the major and minor openings on the proximal face of the body. A groove can be provided in the body wherein the sharpening rods are removable from the clip means and can be seated and manually held in the groove in side-by-side, parallel relationship for the sharpening of pointed objects, such as fish hooks. When removed from the clip means, the rods can be cleaned.

IN THE DRAWINGS

DESCRIPTION OF A PREFERRED EMBODIMENT

Figure 1:
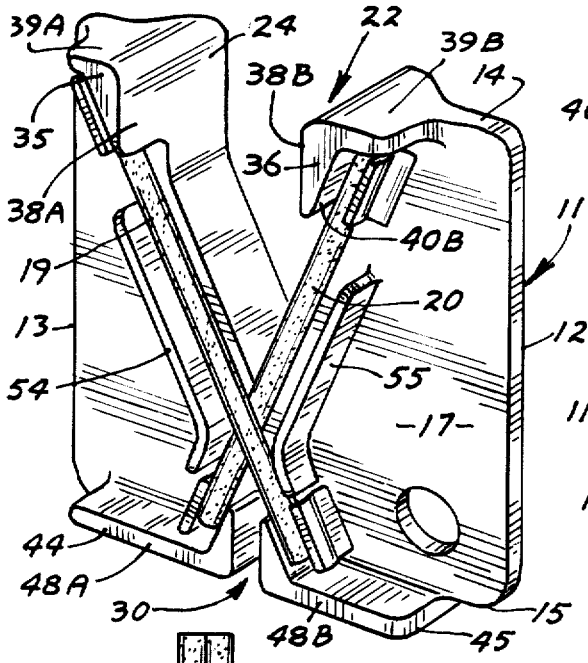
FIG. 1 is a perspective view of a sharpening apparatus of the invention showing the distal face thereof.
Figure 2:
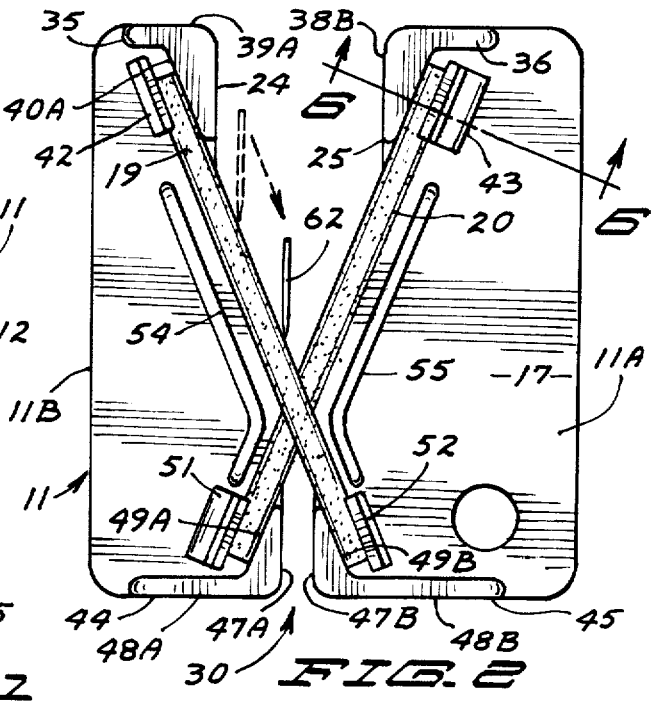
FIG. 2 is a side elevational view of the sharpening apparatus of FIG. 1 showing the distal face.
Figure 3:
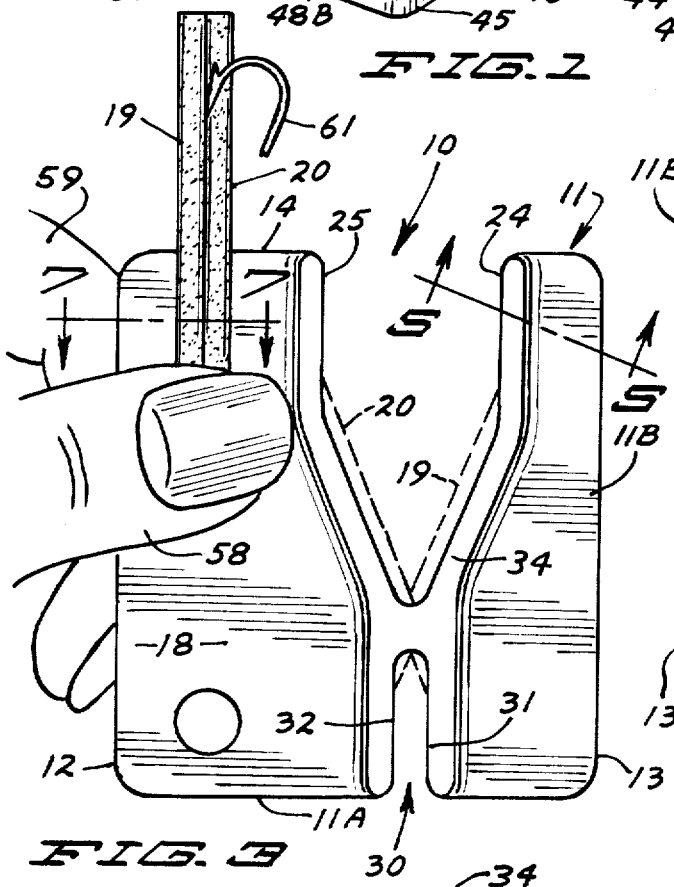
FIG. 3 is a side elevational view of the sharpening apparatus of FIG. 1 showing the proximal face and having the sharpening rods removed from the clip means.

Referring to the drawings, there is shown in FIGS. 1-4 a sharpening apparatus indicated generally at 10 having a planar, flat, generally rectangular body 11 normally disposed in upright orientation with vertical sides 12, 13 and first and second horizontal ends 14, 15. As shown in FIGS. 1-3, the first horizontal end 14 is an upper end and the second horizontal end 15 is a lower end, while in the inverted position of FIG. 4, the opposite is true. Body 11 has a first or distal face 17 being faced away from a user during normal and intended use of apparatus 10, and a second or proximal face 18 being orientated toward a user during normal and intended use of apparatus 10. Body 11 can be relatively small so as to be portable in a pocket, a tackle box, a tool box or the like.

As shown in FIGS. 1 and 2, distal face 17 of body 11 releasably carriers a pair of elongate, cylindrical sharpening rods 19, 20 in crossed relationship. Rods 19, 20 are of a uniform cylindrical dimension and are constituted of abrasive material, such as a ceramic material into which is dispersed an abrasive substance as, for example, aluminum oxide. The rods are carried in side-by-side crossed or X relationship intersecting toward their lower ends as viewed in FIGS. 1 and 2 forming first and second diagonally opposite acute interior V-shaped corners. A first large acute V configuration is oriented toward the first end 14 of body 11 and a second smaller acute V configuration is orientated toward the second end 15 of body 11.

Access to the sharpening rods 19, 20 from the proximal face of body 11 is provided by a major access opening 22 extending inward of body 11 from the first end 14. Major opening 22 has a mouth defined by parallel spaced apart edges 24, 25 and a V-shaped portion extending from the mouth and defined by converging edges 26, 27. Parallel edges 24, 25 are spaced apart less than the corresponding spacing between the upper ends of sharpening rods 19, 20 so as to cover them as viewed from the proximal side. The converging edges 26, 27 are disposed in parallel relationship to portions of the sharpening rods 19, 20 forming the greater V-shaped corner and converge at the intersection of the sharpening rods 19, 20. The converging edges 26, 27 are relatively positioned to expose the interior, facing surfaces of portions of the sharpening rods 19, 20 for access through the major opening 22 from the proximal side 18 of body 11 as shown in phantom in FIG. 3 and in full lines in FIG. 4.

Figure 5:
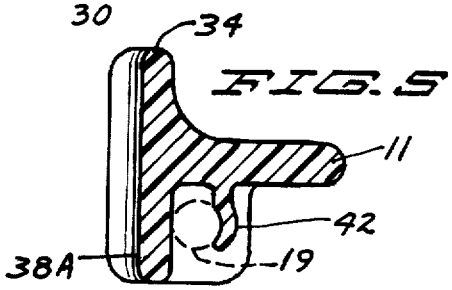
FIG. 5 is an enlarged sectional view of a portion of the sharpening apparatus of FIG. 3 taken along the line 5—5 thereof.

Further access to the sharpening rods from the proximal face 18 of body 11 is provided by a minor access opening or U-shaped slot 30. Slot 30 extends inwardly of body 11 from the second end 15 toward the apex of the V portion of major opening 22, terminating short thereof but extending a sufficient distance to expose the intersecting portion or interior corner of rods 19, 20 opposite that exposed by the major opening 22. Slot 30 is defined by parallel spaced apart sidewalls 31, 32 terminating in a U portion extending over the intersecting portion of the rods 19, 20. A peripheral protective lip 34 lines the major and minor openings on the proximal face of the body 11, extending perpendicularly outward from the proximal face 18 (see FIG. 5). Lip 34 serves to strengthen the body 11 in the vicinity of the major and minor openings, 22, 30, as well as provide a protective barrier to the hand and fingers of a person using the sharpening apparatus 10.

As shown in FIGS. 1 and 2, sharpening rods 19, 20 intersect so as to be upwardly and downwardly divergent at an interior angle of approximately 45 degrees when body 11 is disposed in an upright orientation. Clip means are provided to releasably secure the ends of the sharpening rods 19, 20 to the distal face 17 of body 11 in proper relationship with respect to the major and minor access openings 22, 30 permitting access from proximal face 18. A first pair of L-shaped shoulders or support members 35, 36 is disposed on first end 14 of body 11 adjacent opposite sides of the mouth of major access opening 22 and extending perpendicularly outward from distal face 17. Each shoulder has a vertical leg 38A, B, contiguous with the corresponding vertical edge portion 24, 25 of the mouth of major opening 24 (see FIG. 1), and a horizontal leg 39A, B, contiguous with the first end 14 of body 11.

Figure 6:
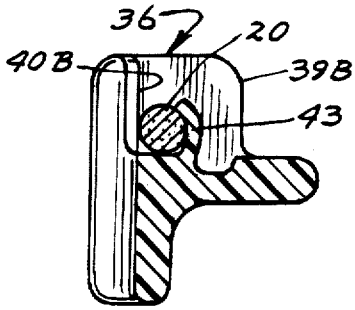
FIG. 6 is an enlarged sectional view of a portion of the sharpening apparatus of FIG. 2 taken along the line 6—6 thereof.

Each shoulder 35, 36 has an inner diagonal surface 40A, B, disposed opposite the outer surfaces of the legs 38, 39 and at an inclination parallel to the intended angular orientation of the rods 19, 20 in position to support a portion of the end of the rod. Resilient, linear clip members 42, 43 are fixed to distal face 17 and are associated with the shoulders 35, 36 respectively. Clip members 42, 43 are parallel to and spaced from respective interior diagonal surfaces 40A, B, to form pockets for receipt of rod ends. As shown in FIG. 6, clip member 43 is arcuate in shape and is spaced from diagonal surface 40B of shoulder 36. The end portion of rod 20 is seated between clip member 43 and diagonal surface 40B. Clip member 43 is resilient whereby the end of rod 20 is insertable and removable under slight force and is axially rotatable when seated with respect to the clip member 43. The same relationship exists between clip member 42 and the diagonal surface 40A of shoulder 35.

A second pair of L-shaped shoulders or support members 44, 45 is disposed on the second end 15 of body 11 adjacent opposite sides of slot 30 and extend perpendicularly outward from distal face 17. Each shoulder has a vertical leg 47A, B, contiguous with the side edges 31, 32 of slot 30, and a horizontal leg 48A, B, contiguous with the second end 15 of body 11. Each shoulder 44, 45 has an interior, diagonally inclined surface 49A, B positioned at an incline parallel to the intended inclination of a rod end. Linear, resilient clip members 51, 52 are parallel to and spaced apart from the surfaces 49A, B, to form clip seats for retention of the ends of the rods 19, 20. The clip members 51, 52 and inclined surfaces 49A, B, function in the same fashion as described with respect to the clip member 43 and the inclined surface 40B of FIG. 6. It may be seen that the clip member 52 and inclined surface 49B are aligned with the clip member 42 and inclined surface 40A for support of first sharpening rod 19, while the clip member 51 and inclined surface 49A of shoulder 44 are aligned with the clip member 43 and inclined surface 40B of shoulder 36 for retention of second sharpening rod 20. As shown in FIG. 1, second rod 20 is disposed inwardly of first rod 19 whereby the diagonally opposite clip members 43, 51 can be shorter than the clip members 52, 42 holding the first rod 19.

Major and minor access openings 22, 30 vertically divide body 11 into two unequal segments 11A, 11B. One segment 11A is wider or has a greater horizontal dimension than the other segment 11B in order to provide usable surface area for apparatus 10 to be grasped and firmly held by a user.

A first safety or guard rail 54 is located on distal side 17 of body 11 extending outwardly therefrom. Rail 54 conforms to the profile of the crossed rods 19, 20 on one segment 11A of body 11. As shown in FIGS. 1 and 2, rail 54 has an upper portion parallel to and spaced from first sharpening rod 19 in the vicinity where a knife will be sharpened. The lower portion extends angularly from the upper portion parallel to the lower part of the second sharpening rod 20 after it has intersected the first sharpening rod 19. Likewise, a second safety or guard rail 55 is disposed opposite the first guard rail 54 relative to the rods 19, 20 and has an upper portion disposed in spaced parallel relationship from the upper part of the second sharpening rod 20. A lower portion extends angularly from the upper portion in parallel relationship to the lower portion of the first sharpening rod 19. The first and second guard rails 54, 55 serve to protect the fingers of a person holding the body 11 and performing a knife-sharpening procedure.

Figure 7:
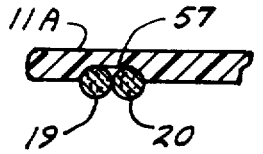
FIG. 7 is a sectional view of a portion of the sharpening apparatus of FIG. 3 taken along the line 7—7 thereof.

An elongate C-shaped linear groove is provided on the proximal face 18 of body 11, extending from first end 14 inward parallel to side 12. Groove 14 is located on the wider portion 11A of body 11 and is adapted to partially retain sharpening rods 19, 20 in parallel side-by-side relationship. As shown in FIGS. 3 and 7, the sharpening rods 19, 20 when removed from the clip means of the body can be placed in partially retained relationship in the groove 57 with the thumb 58 of a user usable to hold the rods in place with respect to the groove 57, being braced by an index finger 59 positioned on the distal side 18 of body 11. As shown in FIG. 7, the transverse dimension of groove 57 is slightly less than the combined diameters of the sharpening rods 19, 20. The ends of the rods 19, 20 extend beyond the first edge 14 of body 11. In this configuration, a pointed member such as the tip of a hook 61 can be sharpened in the trough formed between the rods being held in side-by-side relationship. The inner end of the tip of hook 61 can be sharpened by overlapping the hook over the ends of the rods.

In use of sharpening apparatus 10, body 11 is manually held by a user in the upright orientation of FIGS. 1 and 2, as by having a thumb located on the proximal side 18 of the wider portion 11A of base 11 and having an index finger braced on the opposite side. The proximal side 18 faces the user. Second shoulders 44,45 form a firm base for support of body. A knife having a blade indicated at 62 in FIG. 2, is orientated in a vertical relationship. Vertical side edges 24, 25 of major opening 22 can serve to properly align the knife blade 62 in a vertical orientation. The tip of the blade is in contact with a sharpening rod. The blade is moved down the rod as it is drawn lengthwise, moving at an angle of approximately 22½ degrees, considered to be an optimal blade sharpening angle. Movement of the knife is accomplished along both rods to sharpen both sides of the knife. The rods load up with metal deposits during the sharpening procedure but are rotatable so that clean surfaces can be exposed. The rods can also be removed for cleaning.

Figure 4:
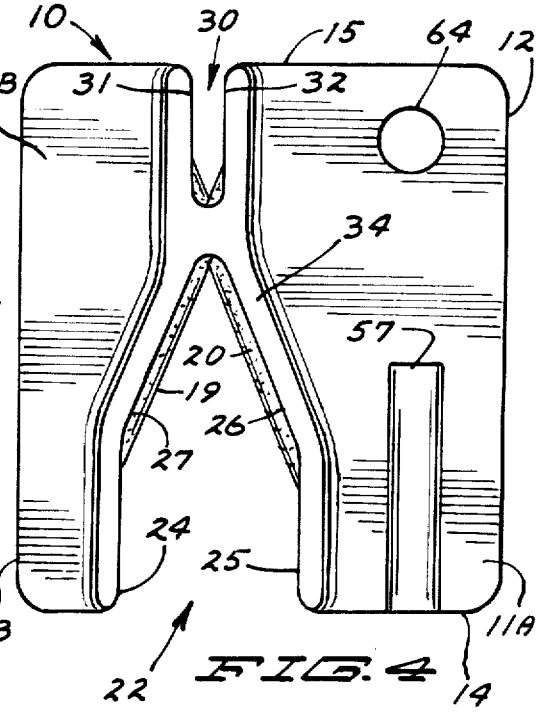
FIG. 4 is a side elevational view of the sharpening apparatus of FIG. 1 showing the proximal face and being in inverted orientation.

The base 11 can be inverted as shown in FIG. 4 wherein a second knife-sharpening area is exposed for sharpening through the minor access opening 30. In such orientation, first shoulders 35, 36 provide a firm base for body 11. The apparatus 10 is further usable in the configuration shown in FIG. 3, as earlier explained.

An opening 64 can be provided in the base 11 for attachment to a key chain or other tether.

While there has been shown and described a preferred embodiment of a sharpening apparatus according to the invention, it will be apparent that certain deviations can be had without departing from the scope and spirit of the invention.

The embodiment of the invention in which an exclusive property or privilege is claimed are defined as follows:

1. A sharpening apparatus comprising:

a body having a proximal face and a distal face;

a pair of thin, elongate sharpening rods;

clip means on the distal face of the body releasably mounting the rods in upright crossed relationship forming first and second diagonally opposite acute interior V-shaped corners;

said body having a major access opening exposing portions of the first and second rods proximate the first V-shaped corner for access from the proximal side of the body by a blade to be sharpened;

said body having a minor access opening opposite the major access opening exposing portions of the first and second rods proximate the second V-shaped corner for access from the proximal face of the body;

said major access opening extending inward from a first end of the body, said minor access opening extending inward from a second end of the body opposite the first end; said first and second rods intersecting on the distal face of the body toward the second end, said major access opening including a mouth comprised of parallel spaced apart edges disposed in covering relationship to ends of the first and second rods as viewed from the proximal side, and a V-shaped portion defined by converging edges parallel to and positioned to expose facing portions of the first and second rods associated with the first acute interior V-shaped corner from the proximal face of the body;

said minor access opening being smaller than the major access opening and comprised as a U-shaped notch extended inward from the second end sufficient to expose the portions of the first and second rods proximate the second interior V-shaped corner from the proximal face of the body;

said clip means including a first pair of L-shaped shoulders disposed on the first end of the body in straddling relationship to the mouth of the major access opening, each L-shaped shoulder having a first leg contiguous with the first end, and a second leg contiguous with an edge of the mouth of the major access opening, and a diagonal surface disposed at an inclination parallel to the intended inclination of a rod, a linear clip member spaced from and parallel to each diagonal surface forming with the diagonal surface a pocket for releasable receipt of the end of a rod;

a second pair of L-shaped shoulders disposed on the second end of the body in straddling relationship to the minor access opening, each having a first leg contiguous with the second end of the body, a second leg contiguous with an edge of the minor access opening, and a diagonal surface disposed at an inclination parallel to the intended inclination of a rod, second linear clip members parallel to and spaced from the diagonal surfaces of the second L-shaped shoulders providing seats for opposite ends of the first and second rods.

2. The sharpening apparatus of claim 1 including: an outwardly extended lip on the proximal face of the body lining the major and minor access openings.

3. The sharpening apparatus of claim 1 including: an elongate C-shaped groove formed on the proximal face of the body extending from one end thereof adapted to at least partially seat the first and second rods in parallel side-by-side relationship for the sharpening of a pointed object.

4. The sharpening apparatus of claim 3 including: an outwardly extended lip on the proximal face of the body lining the major and minor access openings.

5. The sharpening apparatus of claim 1 wherein: said first and second rods are positioned to form first and second diagonally opposite acute interior V-shaped corners of approximately 45 degrees, whereby the parallel spaced apart edge portions defining the mouth of the major access opening are disposed at about 22½ degrees to the sharpening rods.

6. The sharpening apparatus of claim 1 including: a first guard rail located on the distal face of the body positioned in spaced relationship to the sharpening rods opposite the major and minor access openings, and a second guard rail located on the distal face of the body opposite the first guard rail and positioned in spaced relationship to the sharpening rods opposite the major and minor access openings.

7. The sharpening apparatus of claim 6 including: an outwardly extended lip on the proximal face of the body lining the major and minor access openings.

8. A sharpening apparatus comprising:

a flat, planar body having first and second ends and a proximal face for intended orientation toward a user of the apparatus and a distal face for intended orientation away from a user of the apparatus;

a pair of thin, elongate cylindrical sharpening rods;

clip means on the distal face of the body secured to the rod ends releasably mounting the rods in upright crossed relationship forming a first large acute interior V-shaped corner open toward the first end of the body, and a second smaller V-shaped corner open toward the second end of the body;

said body having a major access opening extending inward from the first end of the body and including a mouth defined by parallel, spaced apart edge portions, and a V-shaped portion defined by converging edges extended from the parallel edge portions defining the mouth and extending in parallel relationship to the sharpening rods forming the first V-shaped corner and positioned to expose facing interior portions and cover the remainder of the rods forming the first V-shaped corner from the proximal face of the body for access to the first V-shaped corner from the proximal face of the body by a blade to be sharpened;

said body having a minor access opening comprised as a U-shaped notch extending from the second end of the body toward the first access opening a distance sufficient to expose the second acute V-shaped corner from the proximal side of the base for access by a blade to be sharpened.

9. The sharpening apparatus of claim 8 including: an outwardly extended lip on the proximal face of the body lining the major access opening.

10. The sharpening apparatus of claim 9 wherein: said first and second rods are positioned to form said first acute V-shaped corner of about 45 degrees, whereby the edge portions defining the mouth of the major opening are disposed at an angle of about 22½ degrees to the sharpening rods.

11. The sharpening apparatus of claim 9 including: a first guard rail located on the distal face of the body positioned in generally spaced apart relationship to the sharpening rods opposite the major access opening, and a second guard rail located on the distal face of the body opposite the first guard rail and in generally parallel and spaced apart relationship to the sharpening rods opposite the major access opening.

12. The sharpening apparatus of claim 8 wherein: the first and second sharpening rods are positioned to form the first and second acute interior V-shaped corners at about 45 degrees.

13. The sharpening apparatus of claim 12 including: an outwardly extended lip on the proximal face of the body lining the major and minor access openings.

14. A sharpening apparatus comprising:

a body having a proximal side and a distal side and a planar portion adapted to be manually grasped by a user for sharpening a blade;

a first thin, elongate cylindrical sharpening rod and a second thin, elongate cylindrical sharpening rod;

means releasably mounting the ends of the first and second rods on the distal side of the body with said rods in side-by-side intersecting relationship forming diagonally opposite first and second interior corners;

first means providing V-shaped access opening from the proximal side of the body to the first interior corner of the sharpening rods to expose the adjacent facing rod portions extending from the first interior corner and cover the remaining rod portions to permit access by a blade for purposes of sharpening from the proximal side of the body;

second means providing U-shaped access opening from the proximal side of the body to the second interior corner of the sharpening rods for access by a blade for sharpening from the proximal face of the body; and outwardly extended lip means on the proximal side of the body lining the access openings provided by the first and second means.

15. The sharpening apparatus of claim 14 including: an elongate C-shaped groove on the proximal side of the body adapted to at least partially seat the first and second rods in parallel side-by-side relationship for the sharpening of a pointed object.

16. The sharpening apparatus of claim 14 including: guard rail means located on the distal side of the body spaced from the first and second rods.

17. The sharpening apparatus of claim 14 wherein: means releasably mounting the first and second rods includes clip means releasably holding the ends of the rods.

* * * * *